US009731185B2

(12) United States Patent
Hsu

(10) Patent No.: US 9,731,185 B2
(45) Date of Patent: Aug. 15, 2017

(54) PROTECTIVE FRAME OF A MASK

(71) Applicant: Shih-Huang Hsu, Tainan (TW)

(72) Inventor: Shih-Huang Hsu, Tainan (TW)

( * ) Notice: Subject to any disclaimer, the term of this patent is extended or adjusted under 35 U.S.C. 154(b) by 89 days.

(21) Appl. No.: 14/723,099

(22) Filed: May 27, 2015

(65) Prior Publication Data

US 2016/0346662 A1 Dec. 1, 2016

(51) Int. Cl.
*A63B 71/10* (2006.01)
*A42B 3/20* (2006.01)

(52) U.S. Cl.
CPC ..... *A63B 71/10* (2013.01); *A42B 3/20* (2013.01)

(58) Field of Classification Search
CPC ..... A63B 71/00; A63B 2071/105; A42B 3/20; A42B 3/18; A42B 3/205; Y10T 403/7094; Y10T 403/7045
USPC ..... 2/468, 424, 425, 9; 403/381, 364
See application file for complete search history.

(56) References Cited

U.S. PATENT DOCUMENTS 990,166 A * 4/1911 Rix ..... A42B 3/20 2/9
4,631,758 A * 12/1986 Newman ..... A42B 3/20 2/424
5,093,936 A * 3/1992 Copeland ..... A42B 3/14 2/410
5,963,990 A * 10/1999 White ..... A42B 3/20 2/424
7,765,608 B2 * 8/2010 Durocher ..... A42B 3/20 2/424
2016/0175684 A1 * 6/2016 Sumelius ..... A42B 3/20 2/410

* cited by examiner

*Primary Examiner* — Khoa Huynh
*Assistant Examiner* — Griffin Hall
(74) *Attorney, Agent, or Firm* — Muncy, Geissler, Olds & Lowe, P.C.

(57) ABSTRACT

A protective frame of a mask includes: a first frame unit integrally formed as one piece, and including a first protective part for protecting a portion of a face of a user, and a first connecting part integrally connected to the first protective part; and a second frame unit integrally formed as one piece, and including a second protective part for protecting another portion of the face of the user, and a second connecting part integrally connected to the second protective part. The first connecting part is connected to the second connecting part, and the first frame unit and the second frame unit are connected together to constitute the protective frame.

12 Claims, 5 Drawing Sheets

PROTECTIVE FRAME OF A MASK

FIELD

The disclosure relates to a mask, more particularly to a protective frame of a mask for protecting the face of a user.

BACKGROUND

Athletes such as baseball catchers, softball catchers, kendo players, sword fighters, hockey players and the like often wear protective masks around their heads to protect their heads and faces from injuries. A conventional protective frame of a mask has a structure shown in FIG. 1. This conventional protective frame 1 is usually worn in front of an athlete's face by use of a buffered protector (not shown).

The conventional protective frame 1 constructed into a three-dimensional configuration by assembling multiple metallic bars through welding includes a first bar 11 formed as a closed loop, an U-shaped second bar 12 with two open ends welded to a top segment of the first bar 11, a C-shaped third bar 13 welded forwardly and horizontally across the first bar 11 and the second bar 12, a fourth bar 14 welded forwardly and horizontally across the first, second and third bars 11, 12, 13, a fifth bar 15 formed as a closed loop and welded to the first, second and fourth bars 11, 12, 14, and a plurality of sixth bars 16. The conventional protective frame 1 is essentially composed of a multiplicity of bent metallic bars 11-16 fixed together by welding. The bars 11-16 maybe solid iron bars, which are relatively heavy, or made from aluminum alloys. Note that the directional terms, such as forwardly and horizontally, used hereinabove have their ordinary meanings in terms of direction when the conventional protective frame 1 is worn on a user's face that defines the forward direction.

The welding involved in the fabrication of the conventional protective frame 1 requires manpower, the cost of which, while significant, does not result in consistent, smooth welding joints, especially at right-angled connections, with the finished product being neither appealing to the eye nor easily repairable. Besides, upon impact, the conventional protective frame 1 may dismantle at the welding joints.

SUMMARY

Therefore, an objective of the disclosure is to provide a protective frame that can alleviate at least one of the drawbacks of the prior arts.

According to this disclosure, a protective frame of a mask includes a first frame unit and a second frame unit. The first frame unit is integrally formed as one piece, and includes a first protective part for protecting a portion of a face of a user, and a first connecting part integrally connected to the first protective part. The second frame unit is integrally formed as one piece, and includes a second protective part for protecting another portion of the face of the user, and a second connecting part integrally connected to the second protective part. The first connecting part of the first frame unit is connected to the second connecting part of the second frame unit, and the first frame unit and the second frame unit are connected together to constitute the protective frame.

BRIEF DESCRIPTION OF THE DRAWINGS

Other features and advantages of the disclosure will become apparent in the following detailed description of the embodiments with reference to the accompanying drawings, of which

DETAILED DESCRIPTION

Figure 1:
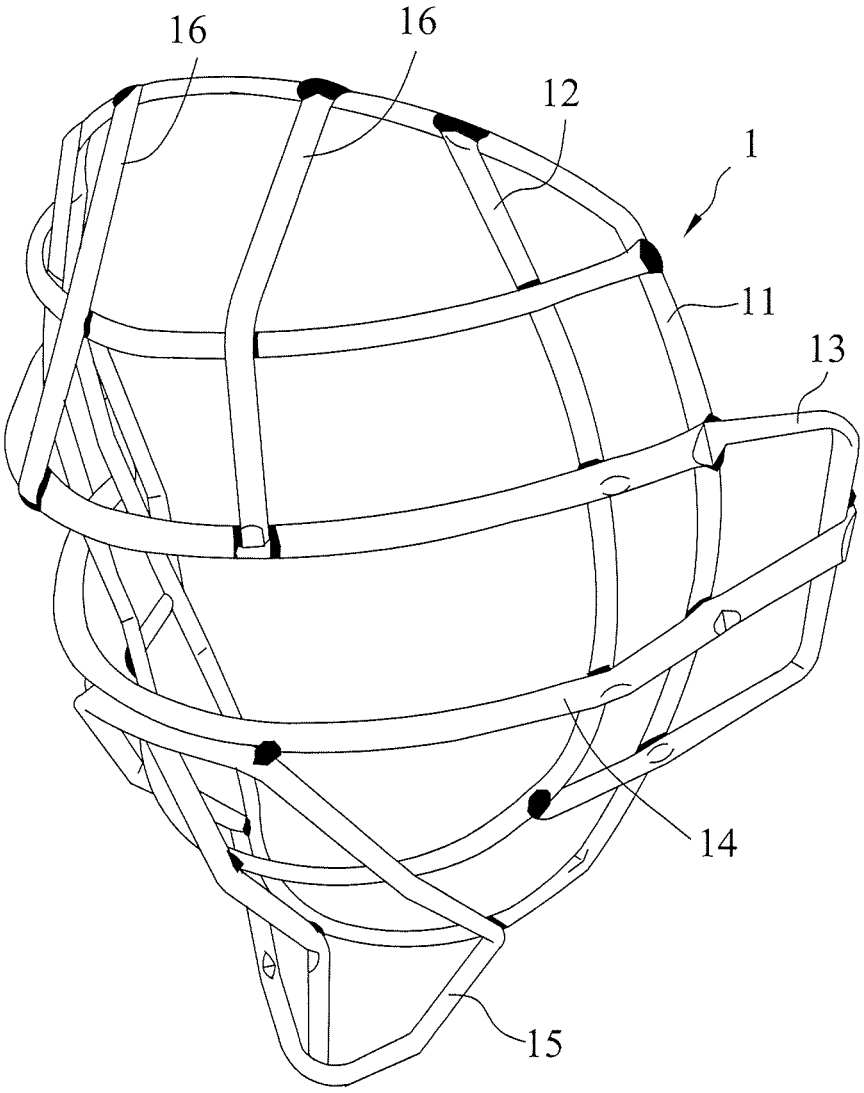
FIG. 1 is a perspective view of a conventional protective frame of a mask.

Before the disclosure is described in greater detail, it should be noted that like elements are denoted by the same reference numerals throughout the disclosure.

Figure 2:
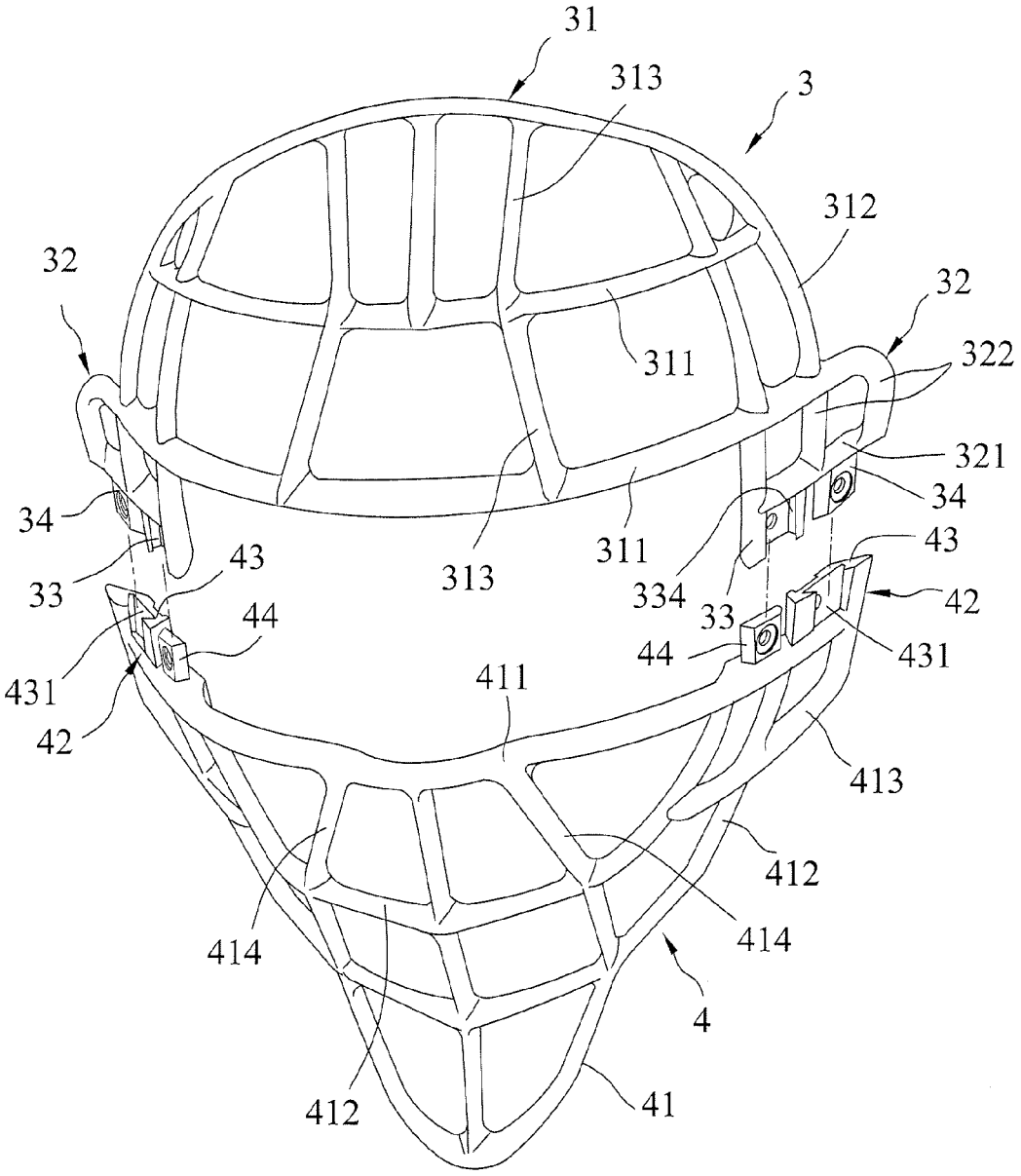
FIG. 2 is an exploded perspective view of an embodiment of a protective frame of a mask according to the disclosure.
Figure 3:
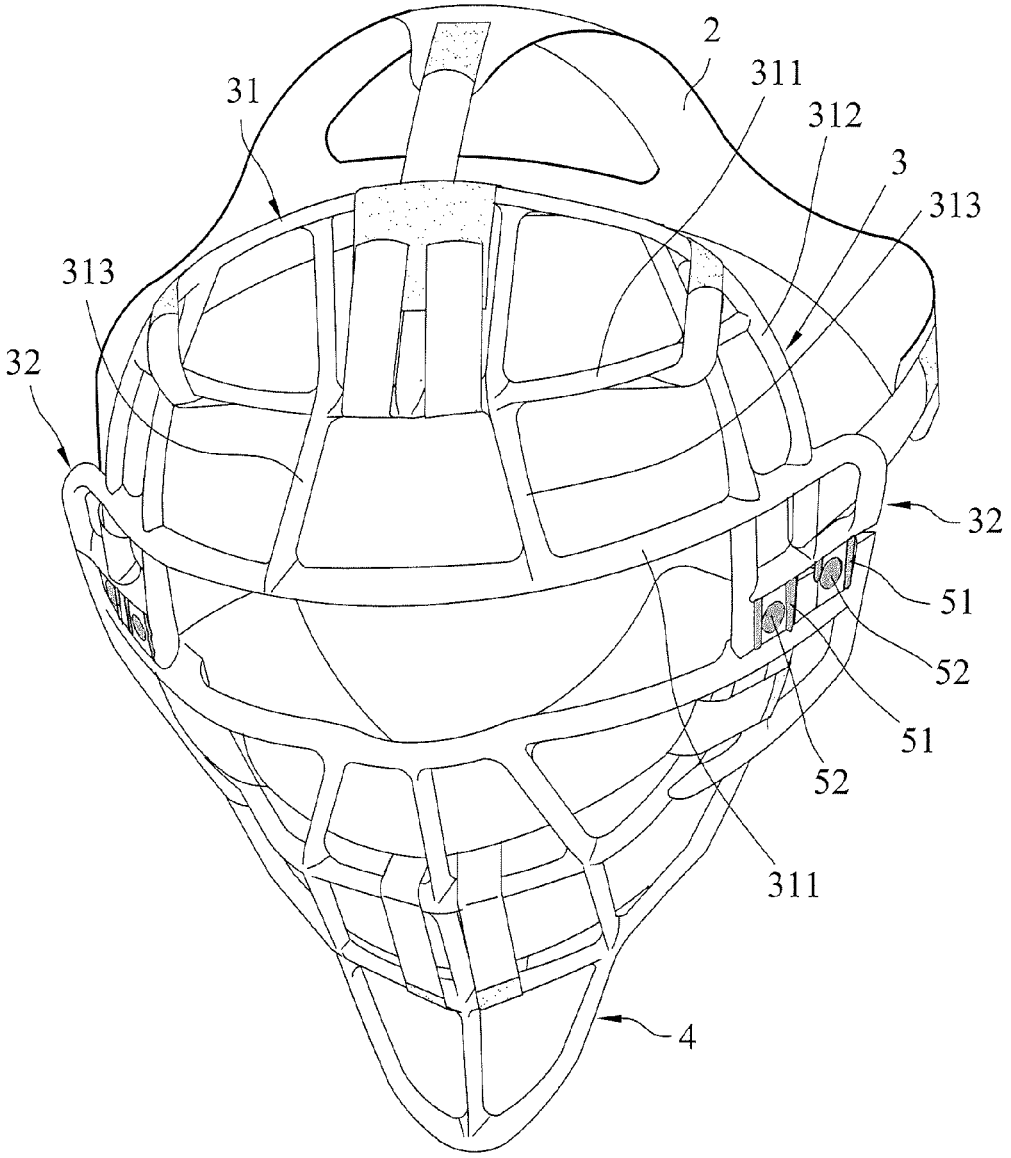
FIG. 3 is a perspective view of the embodiment incorporating with a buffered protector to form a mask.
Figure 4:
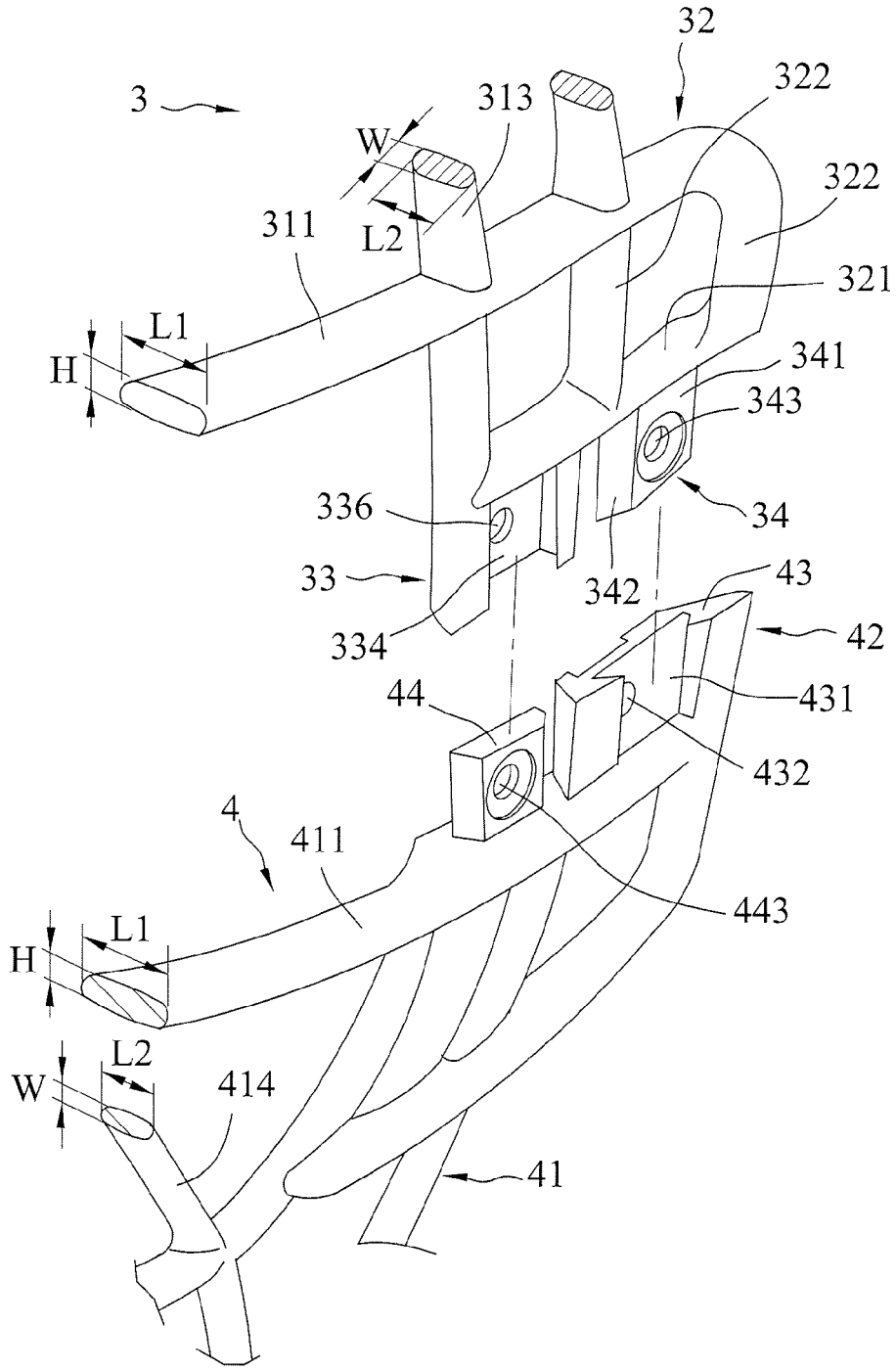
FIG. 4 is a fragmentary exploded perspective view of the embodiment, illustrating the relations between a first connecting part and a second connecting part of the embodiment.

Referring to FIG. 2, FIG. 3, and FIG. 4, an embodiment of the protective frame according to this disclosure can be integrated or incorporated with a buffered protector 2 to be worn around a user's head. The buffered protector 2 mentioned earlier is usually comprised of fabric, sponge, hook and loop fasteners (i.e., Velcro®), etc. Since the feature of this disclosure does not reside in the buffered protector 2, details of the same will not be described further.

The protective frame includes a first frame unit 3 and a second frame unit 4, wherein the first frame unit 3 and the second frame unit 4 are each formed integrally as one piece with metal or a metallic material.

In certain embodiments, the material for manufacturing the first and second frame units 3, 4 is a semi-solid metal metallic alloy, e.g., magnesium alloy with lighter mass than that of aluminum alloys. Magnesium alloys AZ91D and AM50 are preferred. The semi-solid metallic alloy is in a state in which the substance is not melted completely at a temperature ranging between the solidus temperature and the liquidus temperature of the metallic alloy, leading to the co-existence of the liquid metallic alloy and the solid metallic alloy (i.e., in a solid-liquid phase). Melting, solidification and active diffusion may occur at the boundary between the liquid metallic alloy and the solid metallic alloy. In an embodiment, to fabricate the first frame unit 3 and the second frame unit 4, the magnesium alloy is heated to the solid-liquid phase, and is then injection molded using an injection molding machine through the shearing force generated by the rotation of a reciprocating screw. Magnesium alloys are not only lighter than aluminum alloys in mass, but also has superior structural strength, shock absorption and recyclability. Hence integrally molding or forming the first frame unit 3 in one piece and the second frame unit 4 in another piece from magnesium alloys can increase safety and comfort level when wearing a mask with such protective frame incorporated.

The first frame unit 3 and the second frame unit 4 are connected together and are fixed by welding to constitute the protective frame. The first frame unit 3 includes a first protective part 31 for protecting a portion of a face of a user, such as forehead or upper facial area, and two first connecting parts 32 integrally connected to the first protective part 31. In this embodiment, the first connecting parts 32 are spaced apart from each other in a transverse direction transverse to a connecting direction between the first frame unit 3 and the second frame unit 4. The first protective part 31 includes two first right-left bars 311 spaced apart from each other in a bottom-up direction, a curved first outer frame bar 312 joining first right-left bars 311, and a plurality of first bottom-up bars 313 spaced apart from each other in a right-left direction, each joining the first right-left bars 311 or joining one of the first right-left bars 311 and the first outer frame bar 312. As shown in FIG. 4, in this embodiment, each of the first right-left bars 311 and first bottom-up bars 313 is relatively flat in cross section with each of the first right-left bars 311 having a length (L1) in a front-rear direction greater than a thickness (H) in the bottom-up direction and each of the first bottom-up bars 313 with a length (L2) in the front-rear direction greater than a width (W) in the right-left direction. In order to enhance the structural strength and appearance of a front portion of the protective frame, the joints among the first right-left bars 311 and the first bottom-up bars 313 may be rounded.

Figure 5:
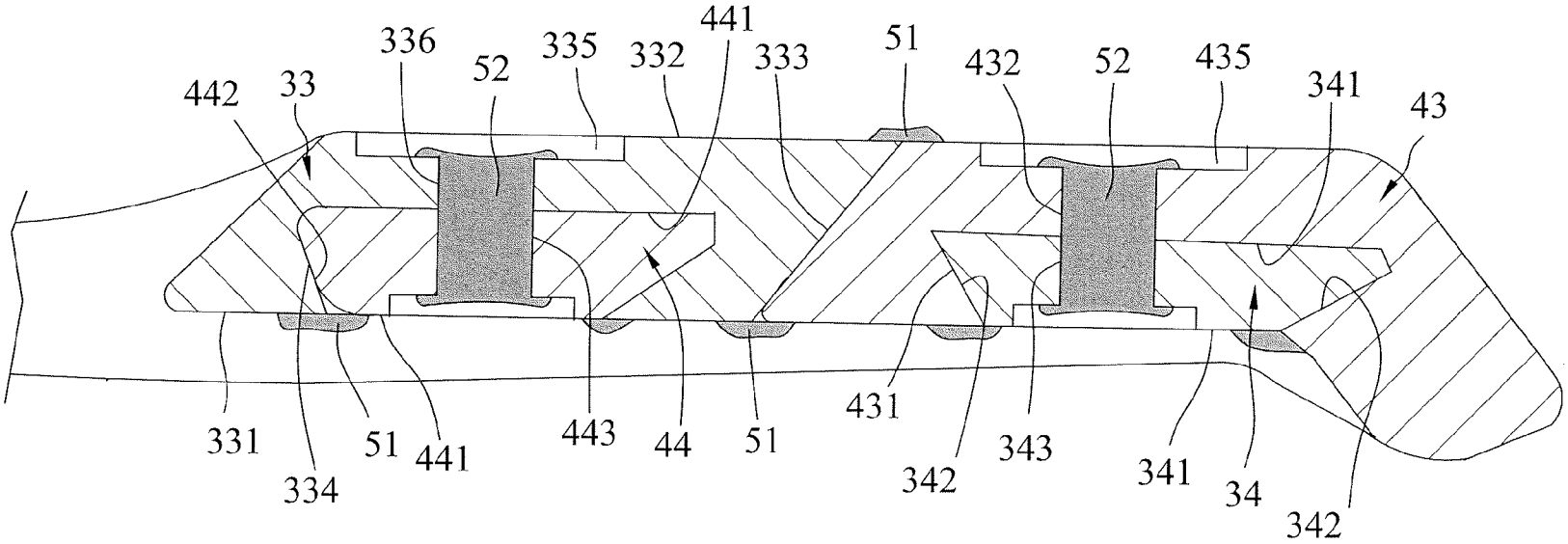
FIG. 5 is a fragmentary sectional view of the embodiment.

Referring to FIG. 2, FIG. 4 and FIG. 5, each of the first connecting parts 32 has a conjoint bar 321 spaced apart from the first right-left bars 311, multiple connecting bars 322 spaced apart in the right-left direction and joining between a lower one of the first right-left bars 311 and the conjoint bar 321, and a first female block 33 and a first male block 34 spaced apart from each other in the transverse direction and protruding from the conjoint bar 321 in the connecting direction. The first female block 33 has a front side 331, a back side 332, a slanting surface 333 interconnecting the front side 331 and the back side 332, a first socket 334 formed in the front side 331, a first groove 335 formed in the back side 332. The first socket 334 has an opening facing a forward direction, and the first socket 334 is narrowed toward the opening. In other words, in the sectional view depicted in FIG. 5, the first socket 334 has a trapezoidal shape with a short side being at the opening. The second frame unit 4 of this embodiment includes a second protective part 41 for protecting another portion of the user's face, such as the user's nose, chin and lower facial area, and two second connecting parts 42 integrally connected to the second protective part 41. The second connecting parts 42 are spaced apart from each other in the transverse direction transverse to the connecting direction between the first frame unit 3 and the second frame unit 4. The second protective part 41 includes a second right-left bar 411 spaced apart from and parallel to the first right-left bars 311 in the bottom-up direction, two arced second outer frame bars 412 placed apart from each other and in connection with the second right-left bar 411, two L shaped side frame bars 413 (only one is labeled), each linked to the second outer frame bars 412 and the second right-left bar 411, and a plurality of second bottom-up bars 414 spaced apart each other in the right-left direction and connected to the second right-left bar 411. As shown in FIG. 4, in this embodiment, each of the second right-left bar 411 and the second bottom-up bars 414 are relatively flat in cross section with the second right-left bar 411 having, for example, the same length (L1) and height (H) as the first right-left bar 311, i.e., the length (L1) in the front-rear direction is greater than the height (H) in the bottom-up direction. Likewise, the length (L2) of each of the second bottom-up bars 414 in the front-rear direction is greater than the width (W) thereof in the right-left direction.

Each of the second connecting parts 42 has a second female block 43 and a second male block 44 spaced apart from each other in the transverse direction and connected to and protruding from the second right-left bar 411 in the connecting direction. The structure of the second female block 43 is similar to the first female block 33, i.e., the second female block 43 is formed with a second socket 431 in a front side thereof, and a second groove 435 formed in a back side thereof. The second socket 431 has an opening facing the forward direction, and the second socket 431 is narrowed toward the opening. In other words, in the sectional view depicted in FIG. 5, the second socket 431 has a trapezoidal shape with a short side being at the opening. In an alternative embodiment, the openings of the first and second sockets 334, 431 may face a rearward direction.

Each of the first connecting parts 32 is connected to a corresponding one of the second connecting parts 42 with the first male block 34 fittingly inserted into the second socket 431 and the second male block 44 fittingly inserted into the first socket 334, and with the female block of the first connecting part 32 abutting against the female block 43 of the second connecting part 42. Specifically, the shape and size of the first male block 34 fittingly match the second socket 431, and the shape and size of the second male block 43 fittingly match the first socket 334. In this embodiment, each of the first and second male blocks 34, 44 has a trapezoidal cross section, and has two parallel surfaces 341, 441, two slanting surfaces 342, 442 interconnecting the parallel surfaces 341, 441. Essentially, each corresponding pair of the female and male blocks is a tongue and groove fitting mechanism. In other embodiments, various sizes and shapes of the female and male sockets can be made differently.

It would be appreciated that it would suffice to have only one first connecting part 32 and only one second connecting part 42, and for the first and second connecting parts 32, 42 to respectively have a female block formed with a socket, and a male block fittingly inserted into the socket. This disclosure is not limited in the number of connecting parts and tongue-and-groove mechanisms used.

In embodiment depicted herein, each of the first female block 33 and the second female block 43 is further formed with a first through hole 336, 432 in spatial communication with a corresponding one of the first socket 334 and second socket 431. Each of the first male block 34 and the second male block 44 is formed with a second through hole 343, 443. The second through holes 343, 443 of the first and second male blocks 34, 44 respectively correspond to and are in spatial communication with the first through holes 432, 336 in the second and first female blocks 43, 33. Each of the first connecting parts 32 and the corresponding one of the second connecting parts 42 are welded together at the first through hole 336 and the second through hole 443 thereof and at an interface between the first connecting part 32 and the second connecting part 42, or specifically, at an interface between the male block 34 of the first connecting part 32 and the female block 43 of the second connecting part 42, at an interface between the male block 44 of the second connecting part 42 and the female block 33 of the first connecting part 32 and at an interface between the female block 33 of the first connecting part 32 and the female block 43 of the second connecting part 42.

In particular, referring to FIG. 2, FIG. 3, and FIG. 5, for each pair of the first and second connecting parts 32, 42, there are multiple surface welds 51 at the interfaces between the male and female blocks 34, 43, between the male and female blocks 44, 33 and between the female blocks 33, 43, and multiple channel welds 52 located inside corresponding pairs of the first and second through holes 336 and 443, and 343 and 432.

It should be noted herein that throughout this disclosure, the directional terms, such as the right-left direction, the front-rear direction, the bottom-up direction, the transverse direction, etc., maybe curved or straight, depending upon the actual structure of the protective frame.

The fabrication process of the protective frame of this embodiment is presented below. First, magnesium alloys are used to form or mold the first frame unit 3 and the second frame unit 4 separately into one piece. Second, the first male blocks 34 of the first frame unit 3 are inserted fittingly and respectively into the second sockets 431 of the second female blocks 43 of the second frame unit 4, and simultaneously the second male blocks 44 of the second frame unit 4 is inserted fittingly and respectively into the first sockets 334 of the first female blocks 33 of the first frame unit 3. Once the insertions are complete, each of the first through holes 336, 432 is aligned with the corresponding one of the second through holes 443, 343. Third, welding is performed to secure the connections between the first and second frame units 3, 4 at locations of the surface welds 51 and channel welds 52. Finally, the protective frame is completed once rough welding edges are smoothed out by oxide removal and heating. It should be noted herein that bolts may be used to interconnect the first and second connecting part 32 and 42 prior to welding in other embodiments.

In conclusion, the protective frame of this disclosure employs magnesium alloys with lighter mass and greater structural strength for integrally forming the first projection frame 3 in one piece and the second frame unit 4 in another. The first frame unit 3 and the second frame unit 4 are joined together by way of tongue-and-groove fitting and the joint is then secured through welding. Furthermore, the finished product appearance and structure integrity are improved and dependence on manpower is reduced.

While the disclosure has been described in connection with what is (are) considered the exemplary embodiment (s), it is understood that this disclosure is not limited to the disclosed embodiment (s) but is intended to cover various arrangements included within the spirit and scope of the broadest interpretation so as to encompass all such modifications and equivalent arrangements.

What is claimed is:

1. A protective frame of a mask, said protective frame comprising:

a first frame unit integrally formed as one piece, and including a first protective part for protecting a portion of a face of a user, and a first connecting part integrally connected to said first protective part;

a second frame unit integrally formed as one piece, and including a second protective part for protecting another portion of the face of the user, and a second connecting part integrally connected to said second protective part;

wherein said first connecting part of said first frame unit is connected to said second connecting part of said second frame unit, and said first frame unit and said second frame unit are connected together to constitute said protective frame;

wherein said first frame unit includes two of said first connecting parts that are spaced apart from each other in a transverse direction transverse to a connecting direction between said first frame unit and said second frame unit, and said second frame unit includes two of said second connecting parts that are spaced apart from each other in the transverse direction;

wherein said first frame unit and said second frame unit are made of a metallic material;

wherein said first and second connecting parts are welded together;

wherein each of said first connecting parts of said first frame unit includes a first female block formed with a first socket, and a first male block;

wherein each of said second connecting parts of said second frame unit includes a second female block formed with a second socket into which said first male block is fittingly inserted, and a second male block fittingly inserted into said first socket in said first female block;

wherein each of said first and second sockets has an opening facing one of a forward direction and a rearward direction, and is narrowed toward said opening; and wherein said first male block has a shape fittingly matching said second socket in said second female block, and said second male block has a shape fittingly matching said first socket in said first female block.

2. The protective frame as claimed in claim 1, wherein each of said first and second female blocks is further formed with a first through hole in spatial communication with a corresponding one of said first and second sockets, and each of said first and second male blocks is formed with a second through hole corresponding to and in spatial communication with said first through hole in a corresponding one of said first and second female blocks, wherein said first and second connecting parts are welded together at said first and second through holes and at an interface between said first and second connecting parts.

3. The protective frame as claimed in claim 2, wherein said first protective part of said first frame unit includes a first right-left bar, and said second protective part of said second frame unit includes a second right-left bar parallel to and spaced apart from said first right-left bar in a bottom-up direction, wherein each of said first and second right-left bars has a length in a front-rear direction greater than a thickness in the bottom-up direction.

4. The protective frame as claimed in claim 3, wherein said first protective part of said first frame unit further includes a plurality of first bottom-up bars spaced apart from each other in a right-left direction and connected to said first right-left bar, and said second protective part of said second frame unit further includes a plurality of second bottom-up bars spaced apart from each other in the right-left direction and connected to said second right-left bar, wherein each of said first and second bottom-up bars has a length in the front-rear direction greater than a width in the right-left direction.

5. The protective frame as claimed in claim 1, wherein for each corresponding one of said first and second connecting parts, one of said first and second connecting parts includes a female block formed with a socket, and the other one of said first and second connecting parts includes a male block fittingly inserted into said socket.

6. The protective frame as claimed in claim 5, wherein said sockets has an opening facing one of a forward direction and a rearward direction, and is narrowed toward said opening, wherein said male block has a shape fittingly matching with said socket.

7. The protective frame as claimed in claim 5, wherein said female block is further formed with a first through hole in spatial communication with said socket, and said male block is formed with a second through hole corresponding to and in spatial communication with said first through hole, wherein said first and second connecting parts are welded together at said first and second through holes and at an interface between said male and female blocks.

8. The protective frame as claimed in claim 5, wherein each of said first and second connecting parts includes said female block and said male block.

9. The protective frame as claimed in claim 8, wherein said male block of said first connecting part is fittingly inserted into said socket in said female block of said second connecting part, and said male block of said second connecting part is fittingly inserted into said socket in said female block of said first connecting part, and said female block of said first connecting part abuts against said female block of said second connecting part.

10. The protective frame as claimed in claim 9, wherein said first and second connecting parts are welded together at an interface between said male block of said first connecting part and said female block of said second connecting part, at an interface between said male block of said second connecting part and said female block of said first connecting part, and at an interface between said female block of said first connecting part and said female block of said second connecting part.

11. The protective frame as claimed in claim 1, wherein said first protective part of said first frame unit includes a first right-left bar, and said second protective part of said second frame unit includes a second right-left bar parallel to and spaced apart from said first right-left bar in a bottom-up direction, wherein each of said first and second right-left bars has a length in a front-rear direction greater than a thickness in the bottom-up direction.

12. The protective frame as claimed in claim 1, wherein said first protective part of said first frame unit includes a plurality of first bottom-up bars spaced apart from each other in a right-left direction, and said second protective part of said second frame unit includes a plurality of second bottom-up bars spaced apart from each other in the right-left direction, wherein each of said first and second bottom-up bars has a length in a front-rear direction greater than a width in the right-left direction.

* * * * *